United States Patent [19]

McErlean

[11] Patent Number: 4,979,707

[45] Date of Patent: Dec. 25, 1990

[54] SUPPORT DEVICE FOR INFANT FEEDERS

[75] Inventor: Matt McErlean, New York, N.Y.

[73] Assignee: Infant Innovations, Inc., New York, N.Y.

[21] Appl. No.: 373,893

[22] Filed: Jun. 29, 1989

[51] Int. Cl.[5] ..... A47D 15/00

[52] U.S. Cl. ..... 248/104; 224/148

[58] Field of Search ..... 248/104, 102, 103, 107, 248/105, 106; 224/148, 201, 222, 267, 265

[56] References Cited

U.S. PATENT DOCUMENTS

| | | | |
|---|---|---|---|
| 2,272,319 | 2/1942 | Elzeer | 248/106 |
| 2,590,383 | 3/1952 | Dean | 248/104 |
| 2,594,545 | 4/1952 | Emens | 248/104 |
| 2,683,055 | 7/1954 | Miner | 248/104 |
| 2,907,539 | 10/1959 | Vardan | 224/148 X |
| 2,938,693 | 5/1960 | Vardan | 248/104 |
| 3,197,099 | 7/1965 | Doba | 248/102 X |
| 3,977,638 | 8/1976 | Woodard | 248/102 |
| 4,114,847 | 9/1978 | Bogensberger | 248/104 |
| 4,498,613 | 2/1985 | Donahue et al. | 248/102 X |
| 4,537,341 | 8/1985 | Kelly | 248/104 X |

*Primary Examiner*—Ramon O. Ramirez

*Attorney, Agent, or Firm*—Klauber & Jackson

[57] ABSTRACT

A nursing bottle holder in accordance with the invention which has a body-engaging member which can be put on and taken off by an adult while holding an infant, a pliable or pliant supporting arm, attached to the body-engaging member and which can be freely flexed in all directions, and a bottle clamp attached to the opposite end of the supporting arm. In one embodiment of the invention, the body-engaging member is in the nature of a hook which is constructed to overlie and engage a shoulder of the wearer. In another embodiment of the invention, the body-engaging member is an extension of the supporting arm and is intended to be wrapped or coiled around the upper arm of the adult.

5 Claims, 2 Drawing Sheets

SUPPORT DEVICE FOR INFANT FEEDERS

FIELD OF THE INVENTION

This invention relates to a nursing bottle holder and is more particularly concerned with an improved nursing bottle holder adapted to be supported by the adult's body and which has maximum flexibility and adjustability for conveniently positioning the bottle.

BACKGROUND OF THE INVENTION

Nursing bottle holders are well known and numerous forms and types have been proposed. One prior type is characterized by means partially or wholly encircling the adult's neck as he or she holds the infant. This type of holder is exemplified by the holders shown in Rodin, U.S. Pat. Nos. 2,494,632; Underwood, 3,016,221; Doba, 3,197,099; Dyer et al, 2,764,376; Baucom, 3,365,153; Brooks, 3,144,230; Marquard, 3,850,393; Woodward. 3,977,638; Kelly, 4,537,341; McClure, 4,718,623; Goldson et al, 4,776,546; and Yang, 4,793,533. These devices are effective to hold the bottle, but they generally require adjustment prior to use for effective vertical positioning; they tend to lie on the plane of the chest of the adult and do not permit ready lateral or omni-directional bottle movement, and they permit only limited (if any) horizontal movement by tending to hang towards the center of the adult's body. Moreover, holders of the nature shown in these patents are of a construction which, for the most part, makes it difficult, or even impossible, to put them on or take them off while holding the infant to be fed. In many cases, it is difficult or impossible to secure bottles in the holders while in use; they permit only limited or no adjustment of bottle position while in use; and where possible, bottle angle adjustment is permitted only on the plane described by the chest of the adult.

Another form of prior nursing bottle holder involves a strap which encircles the body of the adult holding the infant, such as shown in Hampton et al, U.S. Pat. Nos. 4,220,302 and Donahue. 4,498,613. This form of holder in general has many of the limitations described above and, while the device shown in Donahue permits some movement of the bottle, it apparently acts as little more than a safety rope for the bottle and requires the hands of the adult to position the bottle for the infant when the device is to be used.

In another prior form, the holder is in the shape of a bib or upper-body garment to be worn by the mother, such as shown in Patterson, U.S. Pat. No. 4,713,842. Holders of this type cannot be put on while holding the baby and have essentially no adjustability and thus suffer from the several disadvantages enumerated in connection with the first form described.

Still another form of nursing bottle holder hangs over the shoulder of the adult who is feeding the baby. Examples are illustrated in Vardan, U.S. Pat. Nos. 2,893,672, 2,907,539 and 2,938,693. The holders shown in these patents have the advantage of being capable of being put on and taken off while holding the baby but they lack the adjustability often desired when feeding a baby. For example, they do not permit lateral movement of the bottle because the bottle is seemingly always held in the plane described by the chest of the wearer. They do not permit omni-directional bottle movement.

OBJECTS OF THE INVENTION

It is, accordingly, an object of this invention to provide an improved nursing bottle holder.

It is another object of this invention to provide a nursing bottle holder which can be put on and taken off while holding the infant and at the same time is readily adjustable in many directions.

It is a further object of this invention to provide a nursing bottle holder of the character indicated which is readily adjustable laterally.

SUMMARY OF THE INVENTION

These and other objects are provided by a nursing bottle holder in accordance with the invention which comprises a body-engaging member which can be secured to an adult while holding an infant, a pliable or pliant supporting arm attached to the body-engaging member and which can be freely flexed in all directions, and a bottle holding means attached to the opposite end of the supporting arm. The body engaging member while flexible, retains its shape in any selected position, so that the bottle holding means, and in turn the bottle proper, can be fixedly oriented at the selection of the user. In one embodiment of the invention, the body-engaging member is in the nature of a hook constructed to overlie and engage a shoulder of the wearer. In another embodiment of the invention, the body- engaging member is an extension of the supporting arm and is adapted to be wrapped or coiled around the upper arm of the adult. The ready and full adjustability of the bottle nipple angle which is enabled by the present invention, facilitates "rooting", the instinctive lateral movement of a infant's head in search of a nipple to nurse.

BRIEF DESCRIPTION OF THE DRAWINGS

The features of the invention will be readily apparent from the following detailed description of illustrative embodiments thereof and from the accompanying drawings, wherein.

DETAILED DESCRIPTION OF THE PREFERRED EMBODIMENTS

Figure 1:
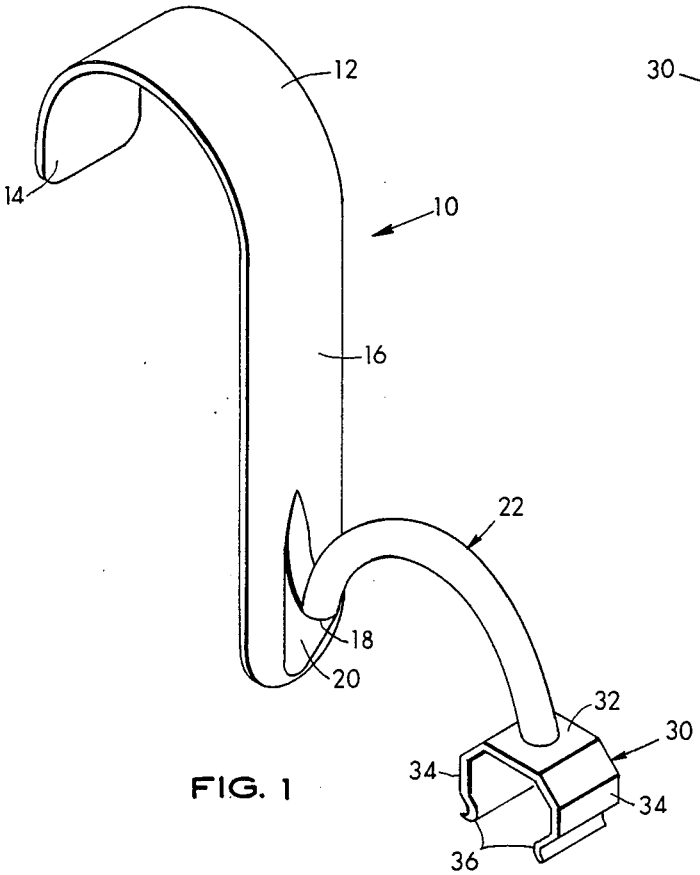
FIG. 1 is a perspective view of a nursing bottle holder embodying features of the present invention.
Figure 2:
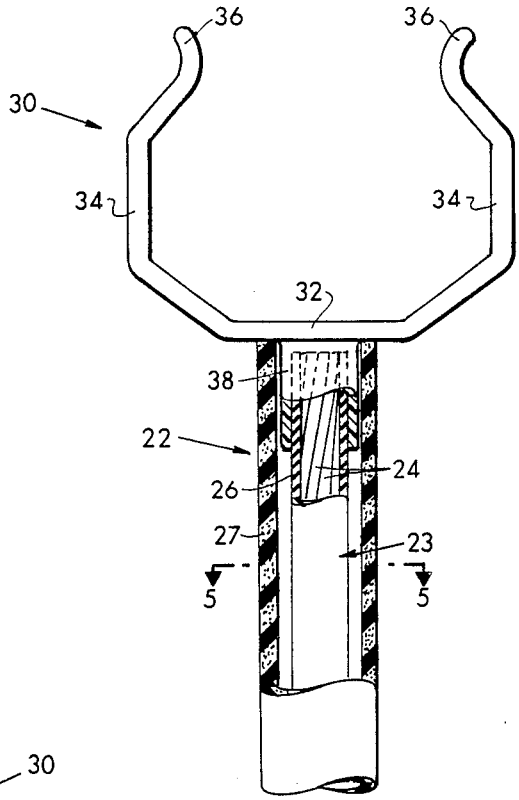
FIG. 2 is an enlarged elevational view, partly in section, of the bottle clamp and a portion of the adjoining supporting arm of the embodiment of FIG. 1.
Figure 5:
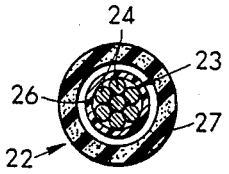
FIG. 5 is a transverse sectional view of the pliable arm taken in the direction 5—5 of FIG. 2.

Referring now to the drawings, and particularly to FIG. 1, the reference numeral 10 designates a nursing bottle holder in accordance with the invention. The nursing bottle holder 10 is formed from a hook-shaped body-engaging member 12 which is constructed to fit over the shoulder of the adult using the holder, and is easily put on the shoulder and taken off, even while the baby is being held with one hand. The hook-shaped body-engaging member 12 is suitably formed from plastic, such as a molded phenolic, of from polyethylene, polypropylene, or the like. The member 12 has a short leg 14 which will engage the wearer's back, and a long leg 16 which will overlie the wearer's chest. At its lower end long leg 16 is formed with an integral socket 18 which has a small-diameter cylindrical recess, which is conveniently for example of ⅜ in. diameter, and is inclined for example at an angle of 30° from the plane of long leg 16. The socket 18 is contained in a forward enlargement 20 extending forwardly from the plane of long leg 16. Received in socket 18 is a pliable and pliant supporting arm 22. As best seen in FIGS. 2 and 5, the supporting arm 22 is preferably formed from a cable 23, e.g., of ⅜ in. diameter, suitably formed from aluminum wire in the form of twisted strands 24 in a sheath 26, such as manufactured by Capital Wire and Cable Co. of Plano, Texas. The sheathed cable 23 is suitably enclosed within a tough skin 27 formed of a rubbery plastic of any convenient type, such as the plastic foam sold under the name Flextron. But the cable extends from the skin a short distance at one end. At this end, the extending cable is received in socket 18 and is held in place by a suitable adhesive. Preferably, the sheath 26 of the cable is formed from plastic , e.g., polyethylene, so that it is readily adhered to the plastic from which socket 18 is formed. Socket 18 and cable sheath 26 are of a diameter that they engage with a snug fit.

At its other end, supporting arm 22 carries a bottle clamp 30, as best seen in FIG. 2. Looking at FIG. 2 and as also seen in FIG. 1, clamp 30, which is suitably formed from plastic such as polyethylene or polypropylene, has a body 32 with legs 34 which have outwardly bent ends 36 and are constructed to resiliently grip a nursing bottle of conventional size and shape and to hold it securely when in use.

The body 32 has an enlargement defining a socket 38 extending from body 32 in a direction away from arms 34. As seen in FIG. 2, the socket 38 is dimensioned to receive the free opposite end of cable 23 and to be overlain by the rubbery skin 22. The end of cable 23 is received in socket 38 with a snug fit and the two are suitably adhesively united, as is the case with the end of cable 23 and the socket 18 in long leg 16 of body-engaging member 12.

When the nursing bottle support 10 is used, the body-engaging member is placed over a shoulder of the adult to do the feeding with the short leg 14 engaging the adult's back and the long leg overlying the adult's chest. The bottle is inserted between the arms 34 of the bottle clamp where it is held in place by the resilient, spring-like clamping action of the clamp arms 34. By reason of the pliability of the arm 22, the bottle can be easily and readily moved into and positioned in a variety of positions, including laterally, yet the bottle is firmly supported at all times. The arm 22 can be bent into any desired position and will hold that position until bent again, but it will move or flex in response to the infant's movements.

As previously mentioned, the nursing bottle holder of the invention has full adjustability with respect to bottle position, and it provides for full adjustability of the nipple angle so that it accommodates the instinctive lateral movement of an infant's head in search of a nipple to nurse. One size will accommodate standard nursing bottles. The device can be put on and taken off easily with one hand while holding the baby, bottle insertion into clamp 30 can be accomplished with one hand, there are no sharp corners, edges, or points and the holder 10 can be readily cleaned by hand or in a dishwasher.

Figure 6:
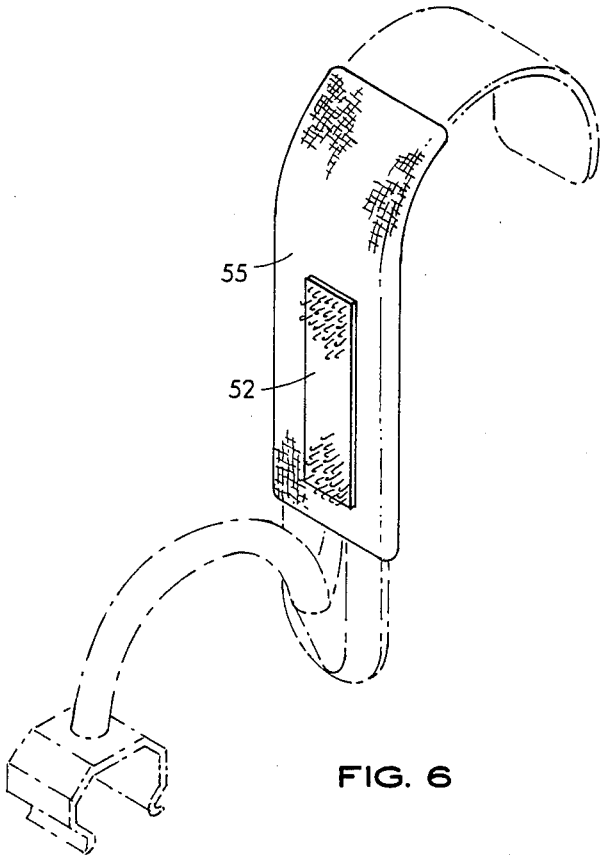
FIG. 6 is a perspective view of a modified form of the nursing bottle holder embodiment of FIG. 1.

As will be apparent from FIG. 6, the nursing bottle holder 10 can be modified, as shown in FIG. 6, to make it more attractive to the infant. A fabric sleeve 55 can be provided which can be slipped over long arm 16. Sleeve 55 is provided with a patch 52 of Velcro hooks. When support 10 is used, a small toy animal or the like, formed or carrying patches of pile fabric or of other material which is engagable or mateable with the Velcro, can be attached to the Velcro patch to amuse the infant while nursing. Alternatively, sleeve 55 can carry other engagement means for a toy or the like, such as snaps, buttons or other conventional fasteners, or elastic bands, which are engagable with mating means on the toy.

Figure 3:
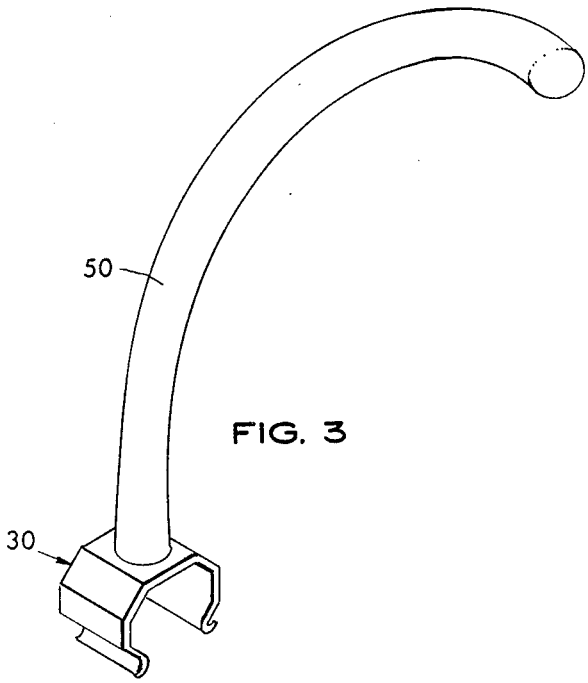
FIG. 3 is a perspective view of another embodiment partly cut away.
Figure 4:
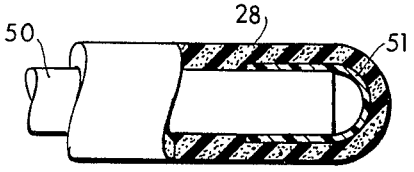
FIG. 4 is a view in elevation, partly broken away, of the end formation of the embodiment of FIG. 3.

In another embodiment of the invention, seen particularly in FIGS. 3 and 4, the body-engaging member takes the form of an extension of the supporting arm 22. Thus, as seen in FIG. 3, wherein the element is elongated (but only partly shown in length) to define a body-engaging member 50 which is of sufficient length, e.g., 30 inches, such that it can be wrapped around the upper arm of the user, rather than being in the form of a shoulder-engaging assembly as in the embodiment of FIG. 1. The body-engaging member 50 is suitably terminated to enclose any sharp edges, as seen in FIG. 4. In FIG. 4, the end of body-engaging member 50 which is, of course, formed from the same sheathed twisted aluminum cable which forms..arm 22, has its free end encased in a molded plastic thimble 51, suitably adhesively secured to it. At the same time, the rubbery plastic skin 28 which envelopes member 50 follows the contour of thimble 52 and gives the body-engaging member a soft, smooth termination.

When the embodiment of FIGS. 3 and 4 is used, the cable 50 with its rubbery envelopes is wrapped two or three times around the upper arm of the adult so that the supporting arm 22 extends across the chest of the adult and firmly but flexibly supports the clamp 30 and the bottle contained by it.

It will be obvious that numerous changes and modifications may be made in the embodiments described without departing from the invention as defined in the appended claims. For example, in the embodiment of FIG. 1, the rubbery, resilient sleeve can be omitted. Similarly, the supporting arm and the body-engaging member can be joined to each other by other means, although the socket arrangement shown has been found to be very effective. Likewise the flexible supporting arm of the invention can be constructed of other materials which are bendable and memory-retentive of their selected shape, including certain plastics and the like. It is intended, therefore, that all matter contained in the foregoing description and in the drawings shall be interpreted as illustrative only and not in a limiting sense.

I claim:

1. A nursing bottle holder comprising:

a body-engaging member in the form of a hook-shaped bracket having a first leg for engagement with the back of a wearer and a second leg for engagement with the chest of a wearer;

a pliable, position-retentive arm that can be flexed in all directions having one end attached to said second leg in such manner as to extend upwardly and outwardly from the chest of the wearer; and a bottle clamp attached to the other end of said arm, said clamp being such that the axis of a bottle it retains is perpendicular to said arm.

2. A nursing bottle holder as defined in claim 1, wherein said body-engaging member is in the form of a bracket adapted to overlie and engage a shoulder of the wearer.

3. A nursing bottle holder as defined in claim 2, wherein said bracket has a shorter leg for engaging the back of the wearer and a longer leg for overlying the chest of the wearer.

4. A nursing bottle holder as defined in claim 1, wherein said arm comprises one or more metallic core members enclosed by a surrounding tubular sheath.

5. A nursing bottle holder as defined in claim 4, wherein said arm is defined by a sheathed cable of twisted wire strands.

* * * * *